US005273001A

United States Patent [19]

Kayahara et al.

[11] Patent Number: 5,273,001

[45] Date of Patent: Dec. 28, 1993

[54] QUADRANGULAR TYPE MULTI-TUBE ONCE-THROUGH BOILER

[76] Inventors: Toshihiro Kayahara, Ko 766-117, Horie-Cho, Matsuyama-shi, Ehime 799-26; Seiji Tai, 11-27, Kamogawa 2-Chrome, Matsuyama-shi, Ehime 791; Sadayoshi Shibakawa, 24, Kitagawara 852, Masaki-Cho, Iyo-Gun, Ehime 791-31, all of Japan

[21] Appl. No.: 41,479

[22] Filed: Apr. 2, 1993

Related U.S. Application Data

[63] Continuation of Ser. No. 720,832, Jun. 22, 1991, Pat. No. 5,199,384.

[30] Foreign Application Priority Data

| | | | |
|---|---|---|---|
| Dec. 22, 1988 | [JP] | Japan | 63-166661[U] |
| Dec. 23, 1988 | [JP] | Japan | 63-167485[U] |
| Feb. 16, 1989 | [JP] | Japan | 1-17457[U] |

[51] Int. Cl.[5] ..... F22B 5/02

[52] U.S. Cl. ..... 122/18; 122/14; 122/138; 122/153; 122/448.3; 122/494

[58] Field of Search ..... 122/14, 18, 138, 153, 122/448.3, 135.1, 510, 494, 1 R, 4 R, 13.1

[56] References Cited

U.S. PATENT DOCUMENTS

| | | | |
|---|---|---|---|
| 4,413,590 | 11/1983 | Landreau | 122/18 |
| 4,499,859 | 2/1985 | Mishiguchi et al. | 122/18 |
| 4,685,426 | 8/1987 | Kidawski et al. | 122/510 X |
| 5,040,470 | 8/1991 | Lofton et al. | 122/135.1 X |

*Primary Examiner*—Edward G. Favors
*Attorney, Agent, or Firm*—Nolte, Nolte and Hunter

[57] ABSTRACT

A quadrangular type multi-tube once-through boiler having an arrangement in which a feed path combuation air, combuation chamber, and an exhaust gas channel passing through a flue are alined in substantially the same plane, and provided with a burner duct (5) and a blower (4) each installed in any desired regions in lateral wall portions ($s_1$, $s_2$, $s_3$ and $s_4$) defining the width of the boiler body (1). The boiler body (1) comprises an assembly (A) of a plurality of substantially vertically disposed water tubes (10), so that combuation gas flows crosswise of the water tubes (10). A burner (3) is disposed in close adjacency to the first row ($1_1$) of water tubes the water tube assembly (A), whereby even if fuel from the burner is ignited in a space between the first row ($1_1$) of water tubes and the burner (3), actual combuation does not proceed to completion therebetween but the most of the unburnt gas burns completely while it flows through water tube clearances.

12 Claims, 8 Drawing Sheets

QUADRANGULAR TYPE MULTI-TUBE ONCE-THROUGH BOILER

This is a continuation of application Ser. No. 07/720,832, filed Jun. 21, 1991 U.S. Pat. No. 5,199,384 and claims the priority of the parent application and of the following foreign applications: PCT application PCT/JP89/01279, filed Dec. 20, 1989; Japanese application UM166,661/1988, filed Dec. 22, 1988; Japanese application UM167,485/1988, filed Dec. 23, 1988 and Japanese application UM17,457/1989, filed Feb. 16, 1989.

DESCRIPTION

1. Technical Field

This invention relates to a multi-tube once-through boiler and more particularly to a guadrangular type multi-tube once-through boiler unit constructed by constituting a boiler body containing water tube assembly and ancillary devices for boiler such as burner means, exhaust gas discharging means, burner duct and blower in a flat rectangular region, and also to a combined structure for boiler unit for equipping a desired number of these boiler units.

2. Background Art

Generally, it has been considered desirable from the standpoint of increased heat exchange efficiency between combustion gas and water tubes that the water tube assembly used in small-sized multi-tube once-through boilers comprise water tubes annularly disposed to define a combustion chaber therein. Therefore, a multi-tube once-through boiler using this type of water tube assembly hasea substantially cylindrically constructed boiler body, with ancillary parts, such as a blower and a water feed pump, disposed around said boiler body.

Another feature of said type of boiler is that the burner is disposed above or below the water tube assembly so that the fuel from the burner burns substantially completely in the interior of the water tube assembly, producing high temperature combustion gases which flow through clearances between the water tubes and into flues. In a boiler using the water tube construction described above, since the ancillary parts are disposed around the boiler body, the boiler installation area is several times as large as that occupied by the boiler body.

Thus, the boiler employing the burner-based combustion system described above together with the cylindrical water tube construction tends to occupy a relatively large installation space depending upon the boiler installation cite and layout condition. For this reason, some multi-tube once-through boilers based on the so-called quadrangular type water tube construction have recently been proposed. In these known quadrangular type multi-tube once-through boilers, the water tube assembly is simply constructed to define an oval or rectangle which provides a relatively large space serving as a combustion chamber; because of this construction, the reduction of the boiler body size has been limited, making it difficult to attain a sufficient saving of installation space.

In recent years, attention has been paid to environmental pollution problems, calling for further reduction of harmful combustion exhaust gases, particularly $NO_x$ and CO gases, from boilers.

Approaches to reduction of such harmful combustion gases include a method in which exhasst gase are re-circulated, another in which water is sprayed over premixed gas, a so-called two-stage combustion method, and a method in which the combustion gas temperature is adjusted by a cold body adjacent the burner and then CO is oxidized in an adiabatic space extending to the heat exchanger. Even if these approaches to reduction are applied to conventional boilers, the problems of increasing boiler size and complicated boiler construction still remain, leading to an increase in cost.

This invention is a novel boiler unit overcoming the problems described above, intended to provide a novel small-sized efficient guadrangular type multi-tube once-through boiler designed so that the boiler body and ancillary parts, such as a blower, can be installed in a limited rectangular parallelepiped space.

Another object of the present invention is to provide a novel combustion system in which it has a minimum space of the combustion chamber for constituting such a boiler of small size and high efficiency and substantial combustion of the fuel is carried out in the space between the water tubes.

Another object of the present invention is to provide a novel package type boiler which is equipped by a plurality of the above-mentioned boilers of small size and high efficiency as a preferred embodiment of the present invention.

Other objectives and examples of application of the present invention will be clarified by the following illustrations.

3. Disclosure of Invention

To achieve the object described above, according to the present invention, there is provided a quadrangular type multitube once-through boiler unit comprising:

a boiler body which is constituted by a boiler casing of substantially rectangular form having a pair of opposing relatively wide end walls and the first and second pairs of opposing relatively narrow side walls and a water tube assembly in which a plurality of vertical water tubes are arranged pallarel each other in said boiler casing, said each water tubes including an upper end connected to the upper header and a lower end connected to the lower header, a burner means provided on one end of said first pair of side walls in said boiler body, an exhaust gas discharging means provided on the other end of said first pair of side walls in said boiler body, a burner duct forming a premixed gas feed line to said burner means for supplying premixed gas to said burner means and a blower equipped to one end of said burner duct said burner means, said exhaust gas discharging means, said burner duct and said blower being positioned outside of the pairs of first and second side walls in said boiler body and inside of the region divided by the pair of extended surfaces of said opposing end walls, said boiler body providing a path forming means for allowing substantially linear passage of the combustion gas from the side of said burner means to the side of said exhaust gas discharging means in said boiler body and forming combustion gas path by said path forming means, said plurality of water tubes constituting a plurality of water tube rows from the first line to the n-th line from said burner means side to said exhaust gas discharging means side in said combustion gas path and the first row of water tube in said water tubes being arranged adjacent to the combustion surface of said burner means.

Further, according to the present invention, there is provided a combined structure of quadrangular type multi-tube once-through boiler units which comprises boiler units operating each separately and a cabinet structure for containing a combination of desired number of said boiler units, said boiler units being multi-tube once-through boilers and each of them comprising:

a boiler body which is constituted by a boiler casing of substantially rectangular form having a pair of opposing relatively wide end walls and the first and second pairs of opposing relatively narrow side walls and a water tube assembly in which a plurality of vertical water tubes are arranged parallel each other in said boiler casing, said each water tubes including an upper end connected to the upper header and a lower end connected to the lower header, and each upper end of them is connected to the upper header and each lower end of them is connected to the lower header, a burner means provided on one end of said first pair of side walls in said boiler body, an exhaust gas discharging means provided on the other end of said first pair of side walls in said boiler body, a burner duct forming a premixed gas feed line to said burner means for supplying premixed gas to said burner means and a blower equipped to one end of said burner duct, said burner means, said exhaust gas discharging means, said burner duct and said blower being positioned outside of the pairs of first and second side walls in said boiler body and inside of the region divided by the pair of extended surfaces of said opposing side walls, said cabinet structure contains a plurality of receiving compartments for receiving a plurality of said boiler units each separately in parallel in a condition said end walls oppose each other.

BEST MODE FOR CARRYING OUT THE INVENTION

Figure 1:
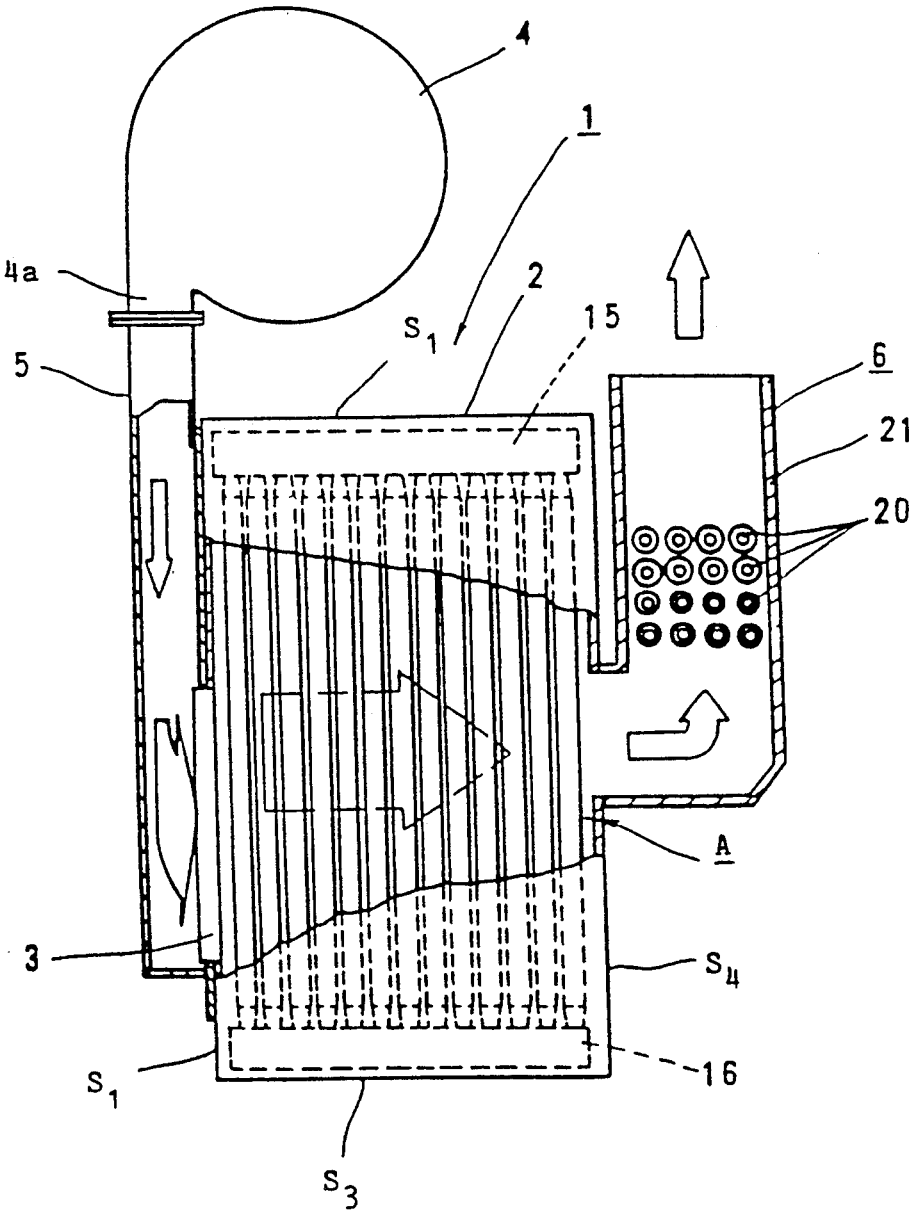
FIG. 1 is a side view, partly broken away, showing an air-combustion gas channel in a quadrangular type multi-tube once-through boiler unit according to this invention.

Practical examples of quadrangular type multi-tube once-through boiler unit according to the present invention are shown in FIGS. 1 to 5. The quadrangular type multi-tube once-through boiler unit according to the present invention comprises basically a boiler body 1 containing a water tube assembly (A), a burner means 3 equipped to one side of said boiler body 1, a burner duct 5 forming a premized gas feed path 5*a* to said burner means 3 for feeding premixed gas to said burner means 3, a blower 4 equipped at one end of said burner duct 5 and an exhaust gas discharging means 6 equipped to the other side of said boiler body 1. Said boiler body 1 is constituted by a boiler casing 2 and a water tube assembly (A). Said boiler casing 2 constitutes a flat rectangular casing by a pair of opposing relatively wide end walls (W), (W) and the first $S_2$, $S_4$ and second $S_1$, $S_3$ pairs of opposing relatively narrow side walls. In the multi-tube once-through boiler unit of square form according to the present invention, each constituting members including said burner means 3, said blower 4, said burner duct 5 and said exhaust gas discharging means 6 are designed to be positioned outside of the pair of first side walls $S_2$, $S_4$ and the pair of second side walls $S_1$, $S_3$ in said boiler body 1 and inside of the region divided by each extended surfaces of said pair of opposing end walls (W), (W). Said boiler body 1 provides a path forming means (P.M) for allowing substantially linear passage of the combustion gas from the side of said burner means 3 to the side of said exhaust gas discharging means 6 in said boiler body 1 and forms a combustion gas path (G.P) by said path forming means (P.M).

The water tube assembly (A) is composed of a plurality of vertically extending substantially parallel water tubes 10. Such assembly (A) is composed of vertically extending quadrangular construction, with combustion gases flowing crosswire of said group of water tubes. In the illustration example, the water tubes 10 disposed on opposite outer sides are connected together by partition members 11, forming water tube walls 12 which are substantially parallel and positioned on opposite sides of the water tube assembly (A).

The intermediate water tubes 10 between the water tube walls 12, 12 on opposite sides are arranged in a number of rows spaced lengthwise (longitudinally) of the water tube walls, each row consisting of two tubes disposed widthwise of the water tube assembly. These water tube rows $l_1$, $l_2$, $l_3$ and so on and the water tubes 10 forming the water tube walls 12 differ in pitch from each other and arranged in zigzag.

In this embodiment, the clearance between adjacent water tubes 10 is nearly equal to or less than the diameter (d) of the water tubes 10. More particularly, the clearance between adjacent water tubes 10 in each of the water tube rows $1_1$, $1_2$, $1_3$ and so on, and the clearance between a water tube 10 in one of two adjacent water tube rows and an adjacent water tube 10 in the other water tube row, and the clearance between a water tube 10 in each of the water tube walls 12 on the opposite sides and a water tube 10 in each of the water tube rows $1_1$, $1_2$, $1_3$ and so on are nearly equal to or less than the diameter (d) of the water tubes 10. In addition, these clearances may be equal to or different from each other provided that the aforesaid condition is met.

Further, the water tubes 10 are connected together at their upper and lower ends by upper and lower headers 15 and 16, respectively, thereby forming a narrow, substantially rectangular water tube assembly (A).

A burner 3 suitable for this embodiment is a premixing type burner, such as a surface combustion burner, positioned at one longitudinal end of the water tube assembly (A).

The clearance between this combustion burner 3 and the first water tube row $1_1$ positioned close thereto is nearly equal to or less than a predetermined distance which is 3 times as large as the diameter (d) of the water tubes 10. The water tube in each of the water tube walls which is closet to the combustion burner 3 is positioned on the basis of said distance.

As for such combustion burner 3, a small-sized high load combustion burner is preferable since the water tube assembly (A) is narrow as described above and since the opening for attaching the burner is limited.

The blower 4 is of the centrifugal type, disposed above the lateral wall portion $S_1$. The delivery port 4*a* of this type of blower 4 is directed downward and disposed on the side of the boiler body 1 where the combustion burner 3 is installed, said delivery port 4*a* being connected to said combustion burner 3 by the burner duct 5 disposed on the wall portion $S_2$.

The burner duct 5 has a width which is nearly equal to or less than the width of water tube assembly (A) and is in the form of a quadrangular pillar, as shown, with a gas feed nozzle (not shown) disposed somewhere in said pillar, so that premixed gas flows from the opening in the outlet side to the burner 3.

The exhaust gas discharging means 6 comprising economizer, said economizer comprises a substantially L-shaped economizer body 21 and horizontally extending finned heat transfer tubes 20 disposed therein in lattice form. The opposite ends of these finned heat transfer tubes 20 extend through the lateral surfaces of the economizer body 21 and open. Of the openings which open to one lateral surface, the four openings on the uppermost row are kept communicating with each other by headers 22*a* and 22*b*, respectively, disposed on the lateral surfaces of the economizer body 21, while the eight tubes in the two middle rows are kept communicating with each other by a similar header 22*c*. The eight openings in the two upper rows and the eight openings in the two lower rows which open to the other lateral surface are kept communicating with each other by headers 22*d* and 22*e*, respectively. Therefore, a vertically extending zigzag channel is defined by the finned heat transfer tubes 20 and the headers 22*a* through 22*e*. Heat transfer fluid (water) enters and leaves the exhaust gas discharging means through inlet and outlet tubes 23 and 24, respectively.

The exhaust gas discharging means 6 of this arrangement is disposed on the side opposed to the combustion burner 3, with the water tube assembly (A) interposed therebetween, in such a manner that the heat transfer tubes 20 extend crosswise of the water tubes 10 of the water tube assembly (A) of the boiler, the width of said economizer being substantially equal to the width of said water tube assembly (A).

In the arrangement described above, combustion air flows downward from the blower 4 via the burner duct 5 and on its way it is mixed with combustiable gas from the gas feed nozzle to provide premixed gas, which is then fed to the combustion burner 3.

Subsequently, the premixed gas flowing out of the combustion burner 3 is ignited in front of the combustion burner 3 to produce flames, traveling from left to right, as shown, through the clearances between the water tubes 10 of the water tube assembly (A), while completely burning. In the meantime, the combustion flames and combustion gases transfer heat to the water tubes 10.

When the combustion gases, leaving the water tube assembly (A), flow into the economizer 6, they flow upward in the latter while transferring heat to the heat transfer tubes 20. Since the water in the heat transfer tubes 20 of the economizer 6 communicates with the four heat transfer tubes 20 in the uppermost row and with the four heat transfer tubes 20 in the lowermost row through headers 22*d*, 22*c* and 22*e*, the water in the transfer tubes 20 in the uppermost row is at a relatively low temperature, so that can be recovered even by the temperature-decreased combustion gases now flowing in the downstream region of the economizer 6. The combustion gases are then discharged through an unillustrated exhaust drum.

During combustion of gas by the burner 3, since the clearance between the first water tube row $1_1$ close thereto and the water tube wall 12 is small, as described above, the flames from the combustion burner 3 extend long in the direction of the length of the water tube assembly as they travel through the clearances between the water tubes in the water tube rows $1_1$, $1_2$, $1_3$ and so on; thus, burning reaction takes place also in these clearances. As a result, the flames from the combustion burner 3 come in contact first with the first water tube row $l_1$, then with the second row $l_2$, then with the third row $l_3$, and so on, while they also come in contact with the water tube walls for successive heat transfer; thus, the flame temperature can be decreased to, e.g., 1200° C.–1300° C. and hence the formation of thermal $NO_x$ can be suppressed.

Since the combustion flames swirl in the clearances between the water tubes 10 because of the presence of the water tubes 10, flame stability is improved and complete combustion is ensured as unburnt gas is rapidly drawn into the flame flow; particularly, CO is oxidized into $CO_2$. Also, the combustion gases, resulting from burning reaction, pass longitudinally of the water tube assembly (A) while coming in contact with the water tube rows and water tube walls and are kept within a relatively low temperature range. This also suppresses thermal dissociation of $CO_2$ into CO.

According to the arrangement described above, it follows that the channels for combustion air and combustion gases are formed in the space of a rectangular parallelepiped of predetermined width. As a result, the width of the entire boiler can be decreased to a value which allows formation of the channels; thus, the boiler width can be greatly decreased as compared with multitube once-through boilers having a conventional combustion chamber.

Furthermore, if the water tube assembly described above is employed, flames from the burner 3 and the channel for combustion gases can be made linearly relatively long in length and hence combustion flames and combustion gases can be allowed to stay in the water tube assembly at relatively low temperatures, saving the need for forming a separate combustion chamber. This accounts for the compactness of the water tube assembly, and the function of swirling flames leads to a decrease in harmful exhaust.

For example, a comparison was made between a conventional water tube assembly and the present inventive water tube assembly as to the amount of harmful exhaust production under the condition that they have the same outer size and operate under the same combustion load, it was found that the present invention decreases $NO_x$ from 70–80 ppm to 40 ppm and CO to as low as not more than 50 ppm. These $NO_x$ and CO values are equal to those for a boiler equipped with a gas circulator when the circulation factor is 10%. According to the boiler of the present invention, however, such harmful-exhaust decreasing function can be attained not by circulating combustion gases but by passing them in one direction only. Furthermore, there is no need for a complicated piping for exhaust gas circulation, so that the construction is very simple.

Figure 6:
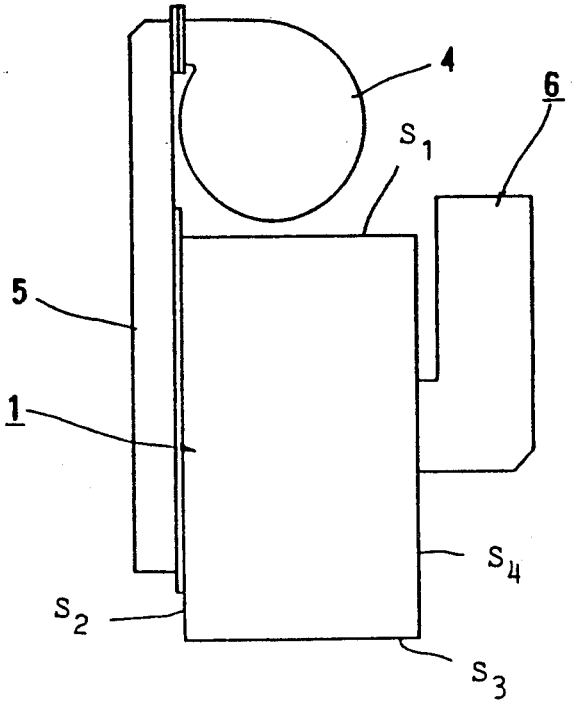
FIG. 6 through FIG. 8 are schematic side views showing another embodiment of a quadrangular type multi-tube once-through boiler unit according to this invention.
Figure 7:
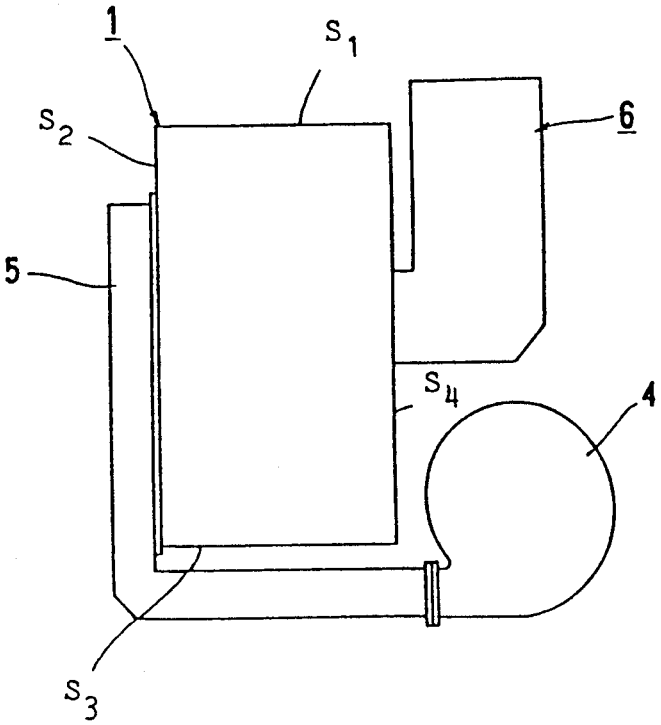
Figure 8:
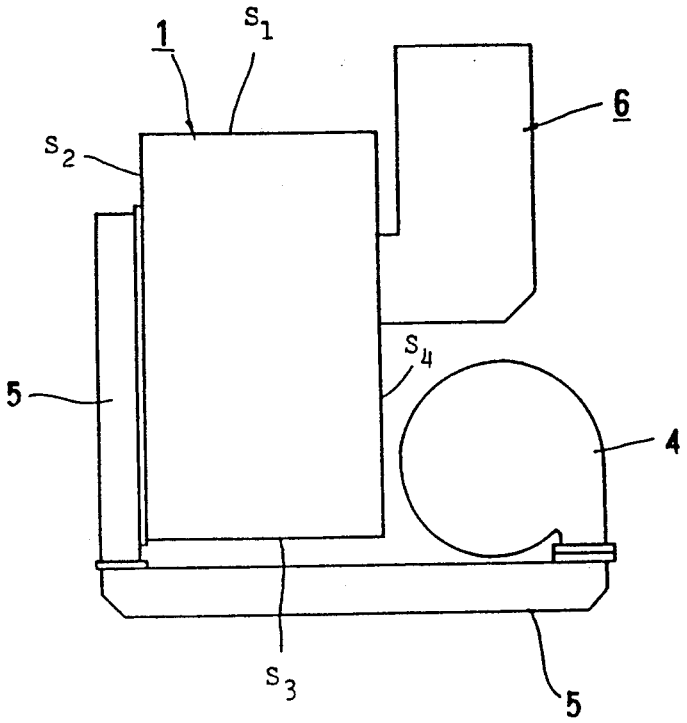

In a quadrangular type multi-tube once-through boiler according to the invention, the disposition and configurations of the blower 4 and burner duct 5 are not limited to the embodiment described above, but they may be changed as shown in FIGS. 6 through 8.

Further, in the quadrangular type multi-tube once-through boiler according to the invention, the water tube assembly is not limited to one having the construction described above, but they may have a construction as shown in FIGS. 9 through 12.

Figure 2:
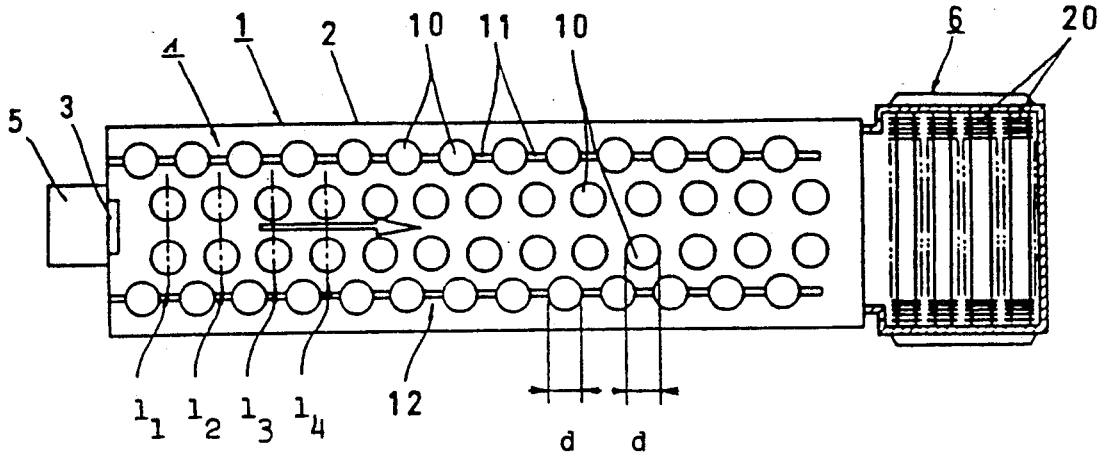
FIG. 2 is a schematic cross sectional view showing the disposition of water tubes included in a water tube assembly in said quadrangular type multi-tube once-through boiler unit.
Figure 3:
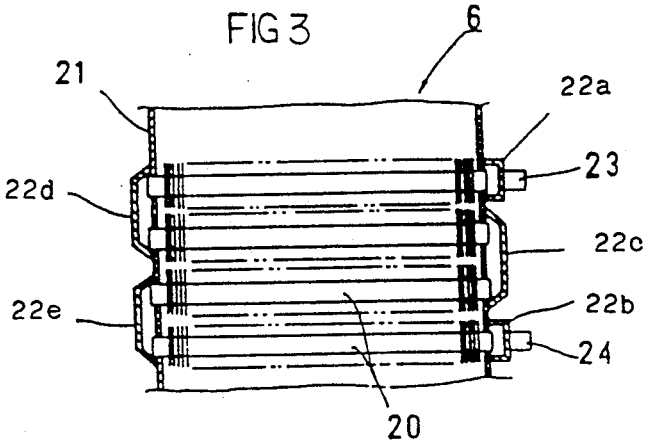
FIG. 3 is a longitudinal sectional view showing part of an economizer used in said quadrangular type multi-tube once-through boiler unit.
Figure 4:
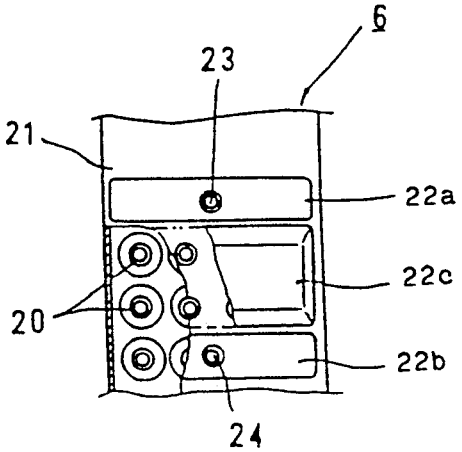
FIG. 4 is a side view, partly broken away, of the economizer of FIG. 3.
Figure 5:
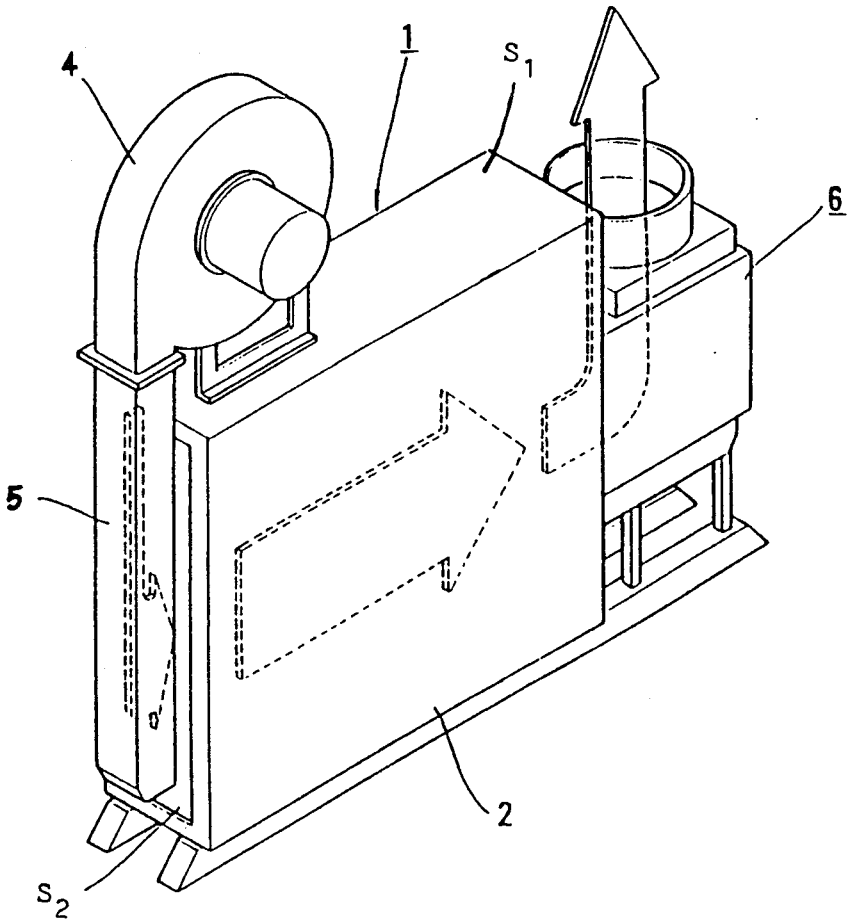
FIG. 5 is a perspective view showing the entire construction of said quadrangular type multi-tube once-through boiler unit.
Figure 9:
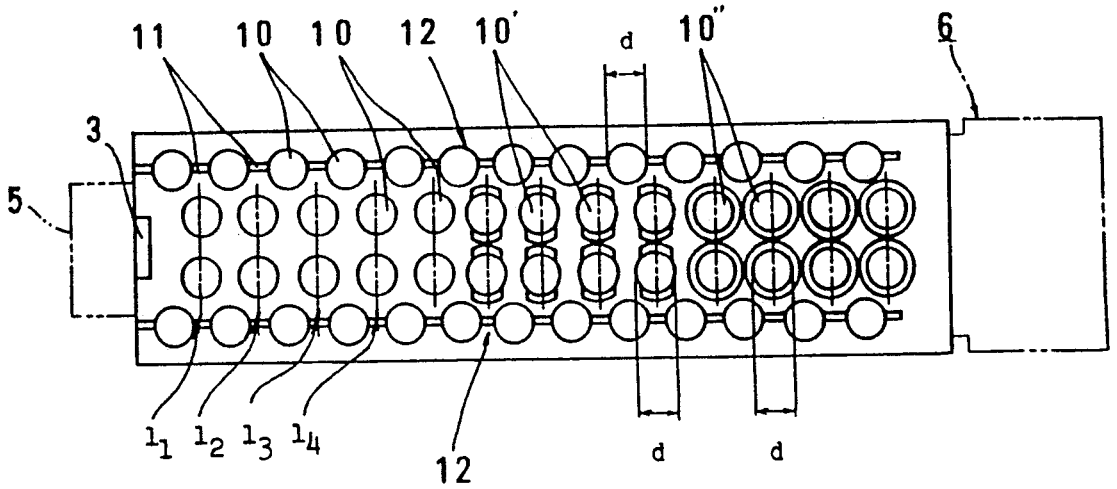
FIG. 9 through FIG. 12 are schematic cross sectional views showing other examples of the construction of the water tube assembly in the quadrangular type multi-tube once-through boiler unit.

The water tube assembly shown in FIG. 9 is a modification of the one shown in FIG. 2. In FIG. 9, two or more groups of water tubes different in heat transfer surface area are arranged in the order of increasing heat transfer surface area as seen from combustion gas upstream side to downstream side. In this example, a group of smooth water tubes 10, a group of laterally-finned water tubes 10' and a group of aerofinned water tubes 10'' are arranged in the order mentioned as seen from combustion gas upstream side to downstream side.

Figure 10:
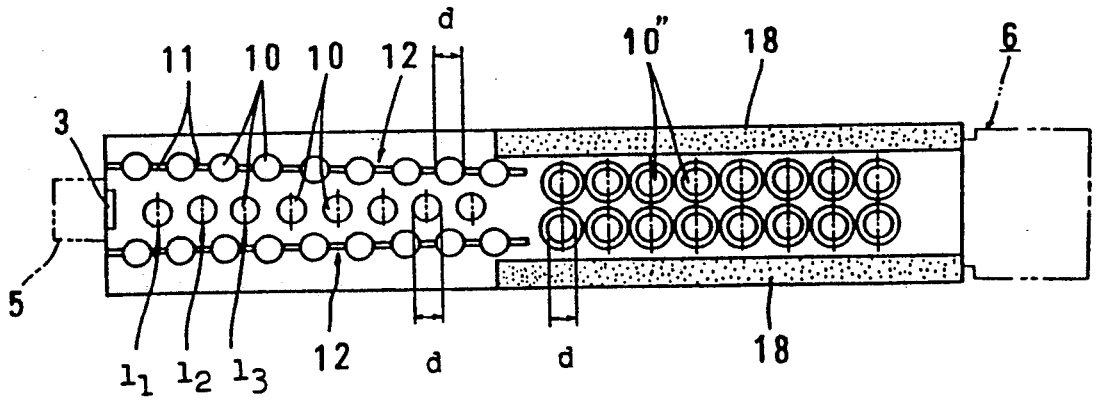

In FIG. 10, the water tube walls 12 extend substantially to the middle of the water tube assembly, and the downstream side is narrowed. Between the water tube walls 12, water tubes 10 in the form of straight tubes are disposed in series, while in the region downstream of said water tube walls 12, two rows of aerofinned water tubes 10'' are disposed between heat insulating walls 18.

Figure 11:
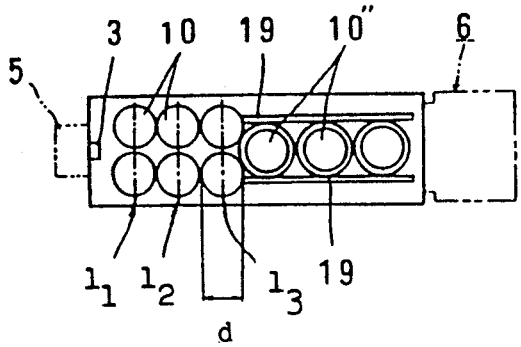

In FIG. 11, the water tube rows $1_1$, $1_2$ and $1_3$, each consisting of two water tubes 10, are disposed immediately in front of the combustion burner 3, said water tube row $1_3$ being followed by three aerofinned water tubes 10'' in a row, and partition walls 19 are disposed on opposite sides of said aerofinned water tubes 10''. The positional relation of the water tubes 10 and 10'' and combustion burner 3 is the same as described above.

Figure 12:
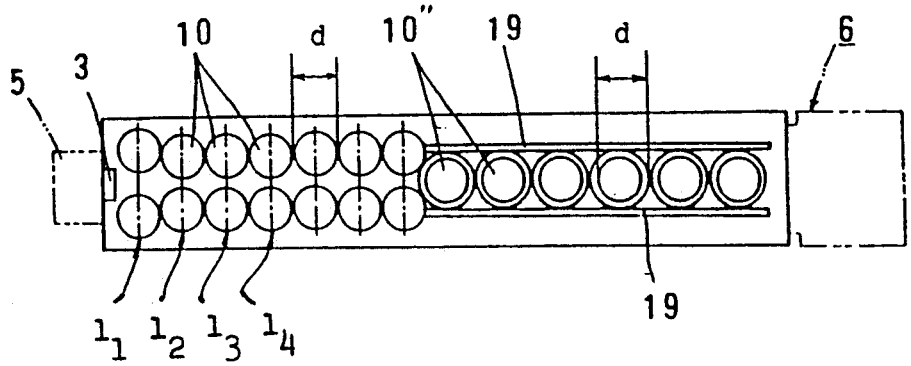

In FIG. 12, the number of water tube rows is 7 and the number of aerofinned water tubes is 6.

Figure 13:
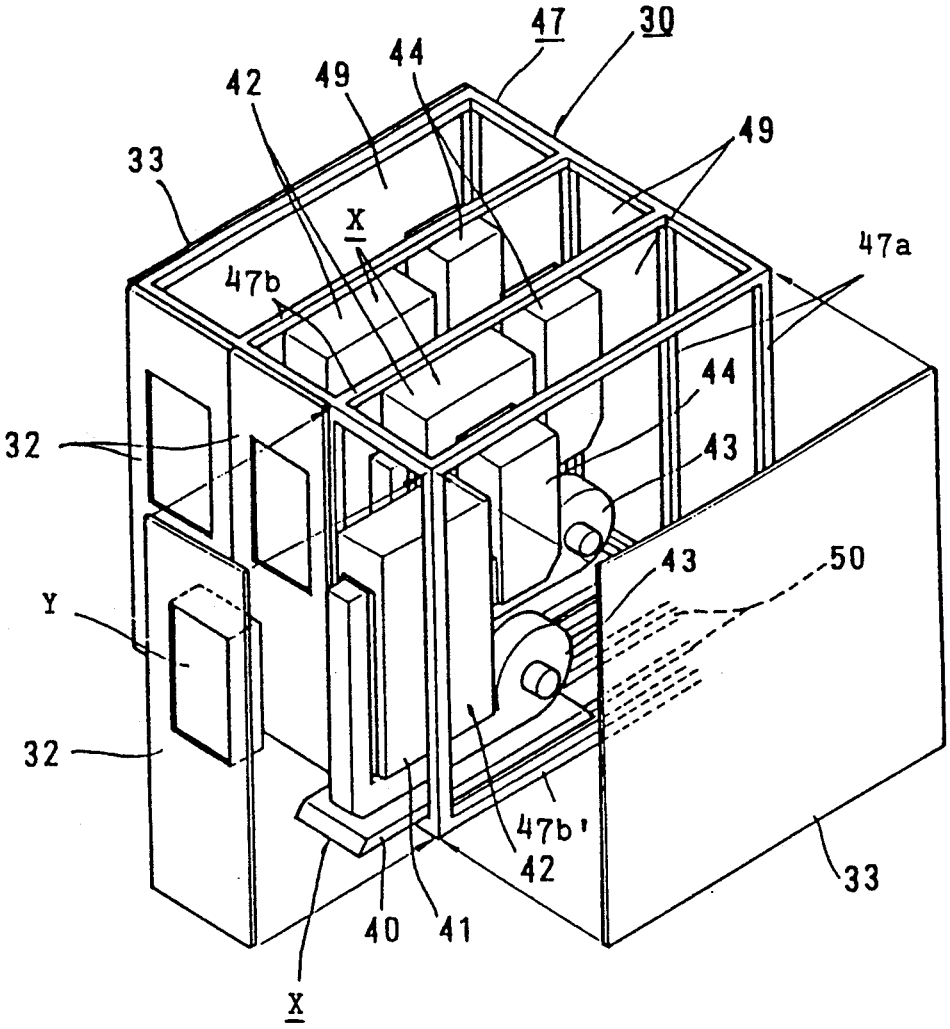
FIG. 13 is a schematic side view showing an embodiment of package boiler unit utilizing the present invention.
Figure 14:
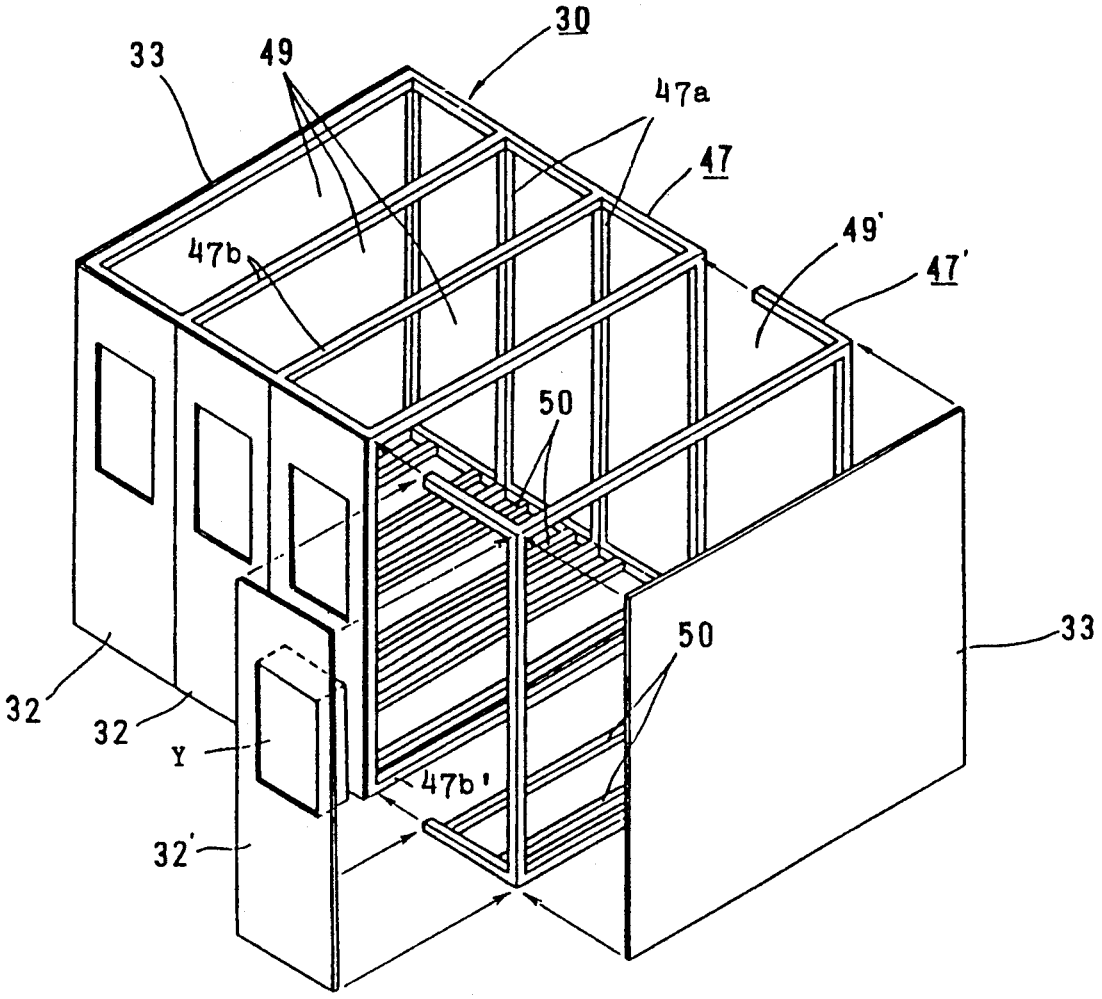
FIG. 14 is a schematic side view showing a modification of the boiler of FIG. 13.

The quadrangular type multi-tube once-through boiler of the present invention develops its merits to a greater extendt when applied to examples (package type) shown in FIGS. 13 and 14.

In these figures, (X) denotes a boiler unit; (Y) denotes control box; 30 denotes a cabinet structure; 32 denotes front sealing panels; 33 denotes lateral sealing panels.

The boiler unit (X) comprises a single boiler body 42 covered with a casing 41 and placed on a bed 40 and acillary parts, such as a burner blower 43 and an economizer 44, attached to said body or bed 40.

The cabinet structure 30, in the embodiment shown in FIG. 13, comprises a required number or a plurality of substantially vertically and horizontally extending connecting members **47*a* and 47*b*, thereby defining three receiving compartments 49. The members defining these receiving compartments are adapted to be separated and connected so as to make it possible to increase or decrease the number of receiving partitions 49**.

In each of the receiving compartments 49 of the cabinet structure 30, rails and rollers can be installed on the connecting members **47*b'* which form the bottom of a frame 47. For example, as shown in FIG. 14, if the bed 40 of the boiler unit (X) is placed on a pair of rails 50 installed in each receiving compartment 49**, the movement of the boiler unit (X) for carrying in and out is facilitated.

Industrial Applicability

As illustrated above, in the quadrangular type multi-tube once-through boiler unit according to the present invention, the air feed path from the blower to the boiler body and the exhaust gas path from the boiler body passing through the flue can be formed substantially on the same plane along the flowing path of combustion gas in the boiler body and the flowing path of the combustion air-combustion gas can be set in a cubic volume of a specified width to largely decrease the width and space of the whole boiler.

Furthermore, the quadrangular type multi-tube once-through boiler unit according to the present invention has a decreased width as mentioned above and each accessaries are arranged to the longitudinal or upper direction of the boiler body and thus the total shape is flat vertical form. This merit can be highly exerted in the multi-boiler system widely used recently.

Furthermore, the boiler body of the quadrangular type multi-tube once-through boiler unit according to the present invention can control the temperatures of combustion flame in the space between the water tubes and combustion gas within a relatively low range by each water tubes and hence special conventional equipments and structures for preventing hazardous exhaust gas are not required to make the structure simple and to lower the cost.

Furthermore, the quadrangular type multi-tube once-through boiler unit according to the present invention, by equipping a economizer in which the heat transfer tubes are arranged crosswise to the water tube direction of said boiler body on the part over the side wall portion facing to the burner duct, increase in the width is substantially nothing and the installing area is not so highly increased by equipping the economizer in such a way as seen in the conventional boiler system.

On the other hand, furthermore, by the combined structure of boiler units by using the multi-tube once-through boiler unit of square form according to the present invention, a desired number of boiler units can be equipped, if required, in the minimum floor space regularly. According to the more preferred example, the plurality of boiler units contained in the cabinet structure can be removed by each boiler unit for repair, inspection and renewal. Further, by providing control boxes in the front of each boiler units, laborsaving operation can be performed and it can be said to actvery effectively in that respect.

We claim:

1. A quadrangular type multi-tube once-through boiler unit comprising:

a boiler casing having four side-walls including a first pair of opposing relatively wide end walls and a pair of opposing relatively narrow side walls, each wall having an inner side, a water tube assembly in which a plurality of vertical water tubes are arranged parallel each other in said boiler casing, each of said vertical water tubes including an upper end connected to an upper header and a lower end connected to a lower header, a burner means, having a combustion system, provided on one end of said pair of side walls in said boiler casing, an exhaust gas discharging means provided on an other end of said pair of side walls in said boiler casing, a burner duct connected to said burner means, a blower equipped to one end of said burner duct, said water tube assembly including a pair of water tube rows each arranged along the inner side of each of said side walls, each of adjacent water tubes of said pair of water tube rows being connected with partition members to form first and second water tube walls, said pair of water tube walls, said upper header and said lower header forming a combustion gas path for allowing substantially linear passage of the combustion gas from the side of said burner means to the side of said exhaust gas discharging means, and said water tube assembly further including a plurality of vertical water tubes arranged between said pair of water tube walls to constitute a plurality of water tube lines from the first line to an n-th line from said burner means side to said exhaust gas discharging means side in said combustion gas path and the first line of water tube in said water tubes being arranged adjacent to the combustion surface of said burner means.

2. A quadrangular type multi-tube once-through boiler unit according to claim 1, in which each water tube line in said water tube assembly comprises more than two water tube groups of different heat transfer surface density from said line side to said n-th line side and arranged in the increasing order from said first line side to the n-th line side.

3. A quadrangular type multi-tube once-through boiler unit according to claim 1, in which the distance between each water tubes in said water tube assembly is substantially equal to or less than the diameter (d) of the water tube.

4. A quadrangular type multi-tube once-through boiler unit according to claim 1, in which said water tubes of each said water tube lines are arranged in a staggered or zigzag relationship with respect to said water tubes forming said water tube walls.

5. A quadrangular type multi-tube once-through boiler unit according to claim 1, in which the distance between said burner means and said first line of said water tube lines positioned close thereto is nearly equal to or less than 3 times as large as the diameter (d) of said water tubes.

6. A quadrangular type multi-tube once-through boiler unit according to claim 1, in which said burner means is a high load combustion burner.

7. A quadrangular type multi-tube once-through boiler unit comprising:

a water tube assembly, in which a plurality of vertical water tubes are arranged parallel each other and in a substantially quadrangular form having an elongated length and a relatively narrow width, each of said water tubes including an upper end connected to an upper header and a lower end connected to a lower header, a burner means, having a combustion surfaces provided on one end of the length of said water tube assembly, an exhaust gas discharging means provided on an other end of the length of said water tube assembly, a burner duct connected to said burner means, a blower equipped to one end of said burner duct, said water tube assembly including a pair of water tube rows each arranged in a direction of the length of said water tube assembly, each adjacent water tubes of said pair of water tube rows being connected with partition members to form first and second water tube walls, said pair of water tube walls, said upper header and said lower header forming a combustion gas path for allowing substantially linear passage of the combustion gas in a direction of the length of said water tube assembly from the side of said burner means to the side of said exhaust gas discharging means, and said water tube assembly further including a plurality of vertical water tubes arranged between said pair of water tube walls to constitute a plurality of water tube lines from the first line to an n-th line from said burner means side to said exhaust gas discharging means side in said combustion gas path and the first line of water tube in said water tubes being arranged adjacent to the combustion surface of said burner means.

8. A quadrangular type multi-tube once-through boiler unit according to claim 7, in which each water tube lines in said water tube assembly comprises more than two water tube groups of different heat transfer surface density from said first line side to said n-th line side and arranged in the increasing order from said first line side to the n-th line side.

9. A quadrangular type multi-tube once-through boiler unit according to claim 7, in which the distance between each water tubes in said water tube assembly is substantially equal to or less than the diameter (d) of the water tube.

10. A quadrangular type multi-tube once-through boiler unit according to claim 7, in which said water tubes of each said water tube lines are arranged in a staggered or zigzag relationship with respect to said water tubes forming said water tube walls.

11. A quadrangular type multi-tube once-through boiler unit according to claim 7, in which the distance between said burner means and said first line of said water tube lines positioned close thereto is nearly equal to or less than 3 times as large as the diameter (d) of said water tubes.

12. A quadrangular type multi-tube once-through boiler unit according to claim 7, in which said burner means is a high load combustion burner.

* * * * *

UNITED STATES PATENT AND TRADEMARK OFFICE

CERTIFICATE OF CORRECTION

PATENT NO. : 5,273,001

DATED : December 28, 1993

INVENTOR(S) : TOSHIHIRO KAYAHARA ET AL.

It is certified that error appears in the above-identified patent and that said Letters Patent is hereby corrected as shown below:

In Column 9, line 16
"system" as there printed should be --surface--.

In Column 10, line 13
"surfaces" as there printed should be --surface--.

Signed and Sealed this

Fourteenth Day of June, 1994

Bruce Lehman

*Attest:*

BRUCE LEHMAN

*Attesting Officer*

*Commissioner of Patents and Trademarks*